US007013978B2

(12) United States Patent
Appleford et al.

(10) Patent No.: US 7,013,978 B2
(45) Date of Patent: Mar. 21, 2006

(54) SYSTEM AND METHOD FOR SEPARATING FLUIDS

(75) Inventors: David Eric Appleford, Epping (GB); Brian William Lane, Canvey Island (GB)

(73) Assignee: Alpha Thames, Ltd., Essex (GB)

( * ) Notice: Subject to any disclaimer, the term of this patent is extended or adjusted under 35 U.S.C. 154(b) by 14 days.

(21) Appl. No.: 10/491,873

(22) PCT Filed: Oct. 11, 2002

(86) PCT No.: PCT/GB02/04637

§ 371 (c)(1),
(2), (4) Date: Apr. 7, 2004

(87) PCT Pub. No.: WO03/033871

PCT Pub. Date: Apr. 24, 2003

(65) Prior Publication Data

US 2004/0244983 A1 Dec. 9, 2004

(30) Foreign Application Priority Data

Oct. 12, 2001 (GB) ..... 0124613

(51) Int. Cl.
*E21B 29/12* (2006.01)

(52) U.S. Cl. ..... 166/357; 166/105.5; 210/787

(58) Field of Classification Search ..... 166/357, 166/105.5, 351; 137/1, 2; 210/787; 73/861.04
See application file for complete search history.

(56) References Cited

U.S. PATENT DOCUMENTS 547,601 A * 10/1895 Everitt ..... 173/100

(Continued)

FOREIGN PATENT DOCUMENTS

GB 2242373 A 10/1991

(Continued)

OTHER PUBLICATIONS

C. Dudgeon; Subsea Water Separation Initiative Enters Phase II; Offshore, Petroleum Publishing Co., Tulsa, US; vol. 58, No. 2, Feb. 1998, p. 44.

(Continued)

*Primary Examiner*—Thomas B. Will
*Assistant Examiner*—Thomas A. Beach
(74) *Attorney, Agent, or Firm*—Summa, Allan & Additon, P.A.

(57) ABSTRACT

A system for separating fluids from a hydrocarbon well production fluid mixture at a subsea location has a centrifugal separator (16) for separating the mixture into gas and liquid. A hydrocyclone separator (32) then separates the liquid into oil and water and an oil-in-water sensor (38) detects the amount of oil in water leaving the separator. If the sensor (38) detects that the water contains more than the prescribed amount of oil, the water is recirculated through the hydrocarbon separator (32) for removal of further oil form water. The hydrocyclone separator (32) has a level interface sensor (66) and if this sensor detects that the oil/water interface is not within prescribed limits for optimum separation of the oil and water, the amount of oil removed from the separator is adjusted until the oil/water interface is within the prescribed limits. The sensors (38, 66) are connected to a control means (68) which controls electrically actuable control valves (42, 58) to cause the water to be recirculated to adjust the amount of oil removed from the hydrocarbon separator. The system also includes a gas slug detection device (14) upstream of the centrifugal separator (16) for sensing the presence of a gas slug in the production fluid. A liquid flow control valve (21) is adjusted by the control means (68) to ensure that the level of liquid in the centrifugal separator (16) does not fall below prescribed limits.

14 Claims, 1 Drawing Sheet

U.S. PATENT DOCUMENTS

Figure 1:
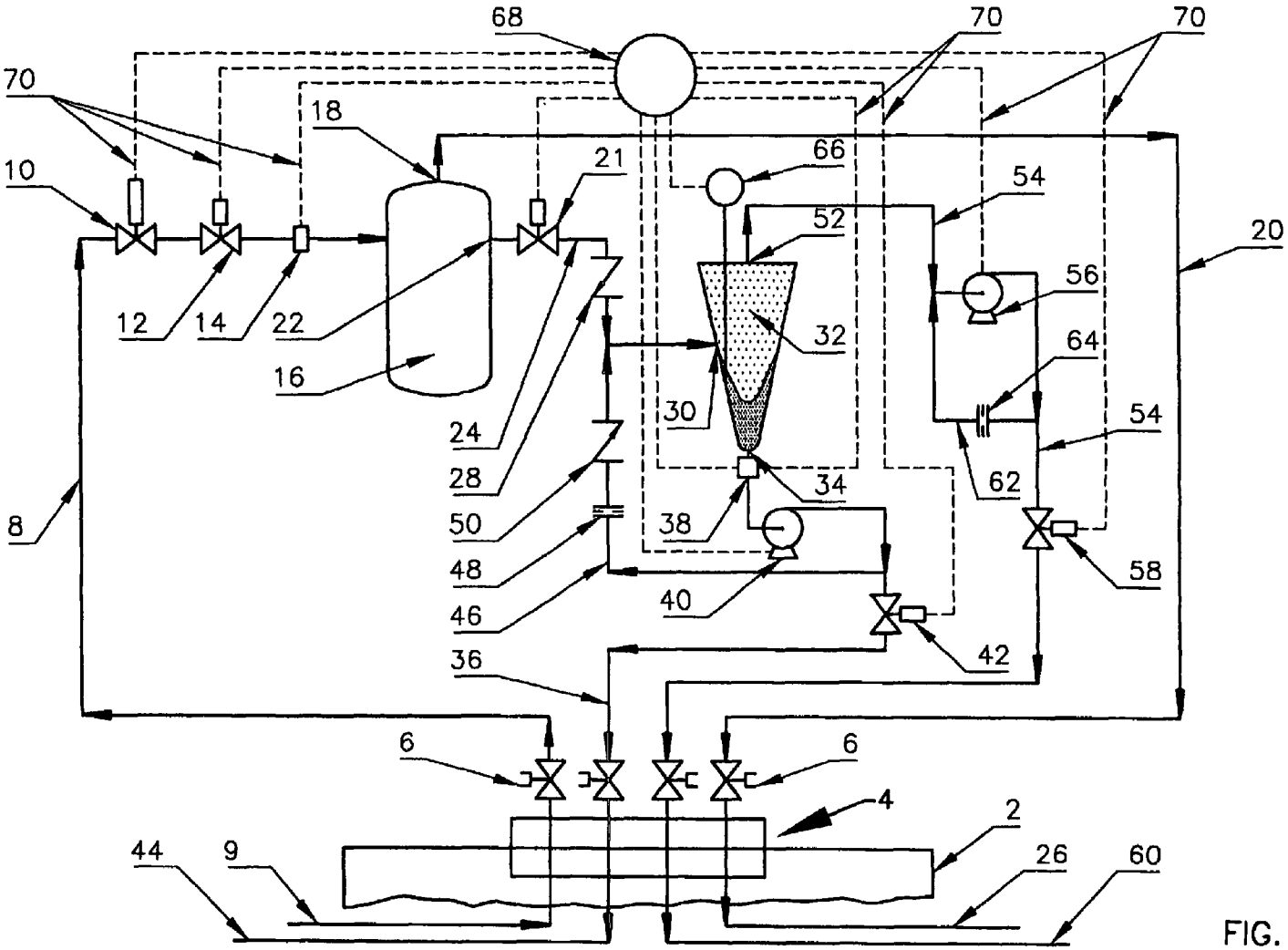

| | | | | | |
|---|---|---|---|---|---|
| 4,589,434 | A | * | 5/1986 | Kelley | 137/1 |
| 5,296,153 | A | * | 3/1994 | Peachey | 210/787 |
| 5,544,672 | A | * | 8/1996 | Payne et al. | 137/1 |
| 5,570,744 | A | | 11/1996 | Weingartn et al. | |
| 5,929,342 | A | * | 7/1999 | Thompson | 73/861.04 |
| 6,068,053 | A | * | 5/2000 | Shaw | 166/267 |
| 6,080,312 | A | * | 6/2000 | Bowers et al. | 210/512.2 |
| 6,082,452 | A | * | 7/2000 | Shaw et al. | 166/105.5 |
| 6,197,095 | B1 | | 3/2001 | Ditria et al. | |
| 6,230,810 | B1 | * | 5/2001 | Rivas | 166/357 |
| 6,253,855 | B1 | * | 7/2001 | Johal et al. | 166/367 |
| 6,327,798 | B1 | * | 12/2001 | Sakai et al. | 37/249 |
| 6,390,114 | B1 | * | 5/2002 | Haandrikman et al. | 137/2 |
| 6,640,901 | B1 | * | 11/2003 | Appleford et al. | 166/357 |
| 6,651,745 | B1 | * | 11/2003 | Lush et al. | 166/357 |
| 6,772,840 | B1 | * | 8/2004 | Headworth | 166/302 |

FOREIGN PATENT DOCUMENTS

| | | |
|---|---|---|
| WO | WO 98/37307 A1 | 8/1998 |
| WO | WO 01/20128 A1 | 3/2001 |

OTHER PUBLICATIONS

K. Arnold et al.; Designing Tomorrow's Compact Separation Train; Society of Petroleum Engineers, vol. SPE, No. 56644, Oct. 3-6, 1999; pp. 1-16.

* cited by examiner

SYSTEM AND METHOD FOR SEPARATING FLUIDS

The present invention relates to the separation of fluids from a fluid mixture included in production fluid from a hydrocarbon well.

Production fluid from a hydrocarbon well generally includes a mixture of oil, water and gas. If the well is under water and there is a requirement to separate the oil, gas and water from each other prior to conveying them to a host facility remote from the well, or other location it is necessary to install some kind of separation means close to the well for this purpose. Gravity separators (which rely on the different specific gravities of the fluids being separated) tend to be relatively large for a particular volumetric throughput of fluids. Other types of fluid separators, such as centrifugal separators and hydrocyclone separators, are relatively more compact for a given volumetric throughput of fluid but only function efficiently if the ratio of different fluids in the mixture they are separating lies within a particular relatively narrow range. Over the course of development of a particular hydrocarbon reservoir, the ratio of oil to water will vary considerably. As the reservoir becomes older, its natural pressure drops and it is customary to inject water and/or gas into the reservoir to boost its pressure. The consequence of this is that the water and/or gas content of the production fluid increases. Since it is a relatively expensive and time consuming activity to replace a separator installed on the sea bed for another designed to operate efficiently for a different range of oil to water and/or gas to oil ratios, and since these ratios may change rapidly and unexpectedly, the use of separators such as centrifugal separators and hydrocyclone separators in sea bed separation systems would not appear to be appropriate.

Furthermore, the presence of gas slugs in the production fluid would also militate against the use of centrifugal and hydrocyclone separators since gas slugs would adversely affect their operation. For example a gas slug entering either a centrifugal or a hydrocyclone separator would be likely to alter the gas/liquid ratio therein to a value outside the range required for it to achieve satisfactory performance.

An object of the invention is to overcome at least some of the problems referred to above.

Thus, according to one aspect of the present invention there is provided a system for separating fluids from a hydrocarbon well production fluid mixture at a subsea location including fluid separation means, electrically actuable fluid flow control valve means and control means for controlling the control valve means to regulate the flow of fluids through the separation means.

As a consequence of the speed at which electrically actuated control valves can operate, adjustment of fluid flow through the separating means can be rapidly adjusted when a slug of gas enters the system and/or when changes of the oil to water ratio in the production fluid occurs. Such a change may occur abruptly, possibly in connection with the arrival at the system of a gas slug in the production fluid, or gradually over a period of time for example as a consequence of changing reservoir characteristics during field life.

The system may include a gas slug detection device for sensing the presence of a gas slug in the production fluid, and wherein the control means is arranged to adjust the control valve means in response to output from the gas slug detection device.

Preferably, the separation means includes a centrifugal separator having a gas outlet and a liquid outlet. The control valve means preferably includes a flow control valve controlled by the control means to restrict flow through the liquid outlet when a gas slug enters the centrifugal separator in order to ensure that substantially no gas passes through the liquid outlet.

Since the production fluid customarily includes oil and water, the separation means preferably includes a liquid separation means, which is preferably a hydrocyclone separator, having a first and second fluid outlet for first and second fluids respectively. The control valve means includes a flow control valve for controlling flow through the first fluid outlet and more preferably a separate flow control valve for controlling flow through each of the first and second fluid outlets.

The or each flow control valve for controlling flows from the liquid separation means is preferably controlled in response to output from a sensor which output is dependent on the amount of one or both of the fluids in the liquid separation means. The sensor may be adapted to sense an interface between the first and second fluids in the liquid separation means.

One or both flow control valves may alternatively or in addition be controlled in response to a contamination sensor adapted to detect the contamination of one of the fluids by the other flowing through one of the outlets. In particular, the sensor may be adapted to sense the amount of oil in water flowing out of the liquid separation means. When such contamination is above a particular threshold, the contaminated fluid (e.g. water contaminated with oil) may be returned to the liquid separation means for further processing via water recirculation means.

A pump may be situated between at least one said fluid outlet and its associated flow control valve for drawing one of the fluids through the respective outlet. Means may be provided for recirculating at least a portion of the fluid flowing out of one of the fluid outlets when its associated flow control valve is at least partially closed.

The system may be incorporated in a retrievable module. The module may be of the general type forming part of the modular system designed by Alpha Thames Limited of Essex, United Kingdom, and referred to as AlphaPRIME and connected to a base structure by a multi-ported fluid connector for enabling isolation of the module from the base.

According to another aspect of the present invention there is provided a method of separating fluids from a hydrocarbon well production fluid mixture at a subsea location including providing fluid separation means, electrically actuable fluid flow control valve means and control means for controlling the control valve means to regulate the flow of fluids through the separation means.

The invention will now be described by way of example only with reference to the accompanying sole FIG. 1 which schematically shows a system in accordance with the present invention.

The system is connected to a base structure 2 by means of a multi-ported fluid connector 4. Each pipe leading to or from the fluid connector 4 includes an isolation valve 6.

A production fluid inlet pipe 8 is connected to receive fluid from a hydrocarbon well via a production fluid flowline 9. The production fluid will include oil, water, gas in solution and may include slugs of gas. The pipe 8 routes the production fluid through a fail-safe valve 10, a pressure control valve 12 and a slug detection device 14 into a compact centrifugal separator 16. The slug detection device may be of the type produced by Caltec Ltd of Cranfield, Bedfordshire, United Kingdom.

The separator 16 has a gas outlet 18 leading into a gas outlet pipe 20 and a liquid outlet 22 leading through a liquid flow control valve 21 into a liquid outlet pipe 24. The gas outlet pipe 20 is connected via one of the isolation valves 6 to the fluid connector 4 for connection to a gas pipeline 26 for conveying gas to a remote location.

The fluid outlet pipe 24 routes fluid from the separator 16 through a first non-return valve 28 to an inlet 30 of a hydrocyclone separator 32.

A water outlet 34 of the hydrocyclone 32 is connected to a water outlet pipe 36 which routes water through an oil-in-water sensor 38, a water pump 40, a water flow control valve 42 and one of the isolation valves 6 to the fluid connector 4 for connection to a water pipeline 44. The oil-in-water sensor 38 may be a Jorin Vipa sensor produced by Jorin Ltd of Sandhurst, Berkshire, United Kingdom.

A water recirculation pipe 46 leads from the water outlet pipe 36, from between the pump 40 and the water flow control valve 42, through a flow restrictor 48 and second non-return valve 50 to a point on the fluid outlet pipe 24 downstream of the first non-return valve 28.

An oil outlet 52 of the hydrocyclone 32 is connected to an oil outlet pipe 54 which routes oil through an oil pump 56, an oil flow control valve 58 and one of the isolation valves 6 to the fluid connector 4 for connection to an oil pipeline 60 for conveying oil to a remote location. An oil recirculation pipe 62 leads from the oil outlet pipe 54, from a point between the oil pump 56 and the oil flow control valve 58, through a flow restrictor 64 to a point on the oil outlet pipe 54 upstream of the oil pump 56.

The hydrocyclone 32 contains a level interface sensor 66 for detecting whether the hydrocyclone contains the optimum amount of oil and water in order to function efficiently.

A control means 68 is linked by signal and/or power connections 70 (shown dotted and only some numbered) to the components as depicted in the FIGURE and receives signals from the slug detection device 14, the oil-in-water sensor 38, the hydrocyclone level interface sensor 66 and other sensors indicating for example the positions of the flow control valves 21, 42 and 58. Rapid electrical control of the electrically actuated flow control valves 21, 42 and 58, the pumps 40 and 56, the failsafe valve 10 etc. is effected by the control means 68 via the connections 70.

The operation of the system will now be described.

Production fluid flowing into the system from the production fluid pipeline 9 passes through the production fluid pipe 8, failsafe valve 10, pressure control valve 12 and gas slug detection device 14 into the centrifugal separator 16. Gas leaves the separator 16 via the gas outlet 18 and passes via the gas outlet pipe 20 to the gas pipeline 26.

Fluid, comprising a mixture of oil and water, leaves the separator 16 via the fluid outlet 22 and passes through the liquid outlet pipe 24 via the liquid flow control valve 21 and the first non-return valve 28 to the inlet 30 of the hydrocyclone 32.

Inside the hydrocyclone, the cyclonic flow of oil and water separates the oil from the water in a manner well known in the art. Oil leaves the hydrocyclone 32 through the oil outlet 52 and passes through the oil outlet pipe 54 and via the oil pump 56 (in which its pressure is raised) and the oil flow control valve 58 to the oil pipeline 60. Water leaves the hydrocyclone 32 through the water outlet 34 and passes through the water outlet pipe 36 and via the water pump 40 (in which its pressure is raised) and water flow control valve 42 to the water pipeline 44.

If a slug of gas enters the system from the production fluid pipeline 9, its presence is detected by the gas slug detection device 14 which sends an appropriate signal to the control means 68. The control means then effects rapid at least partial closure of the liquid flow control valve 21 to ensure that the level of liquid in the separator does not fall below prescribed limits and that substantially no gas enters the liquid outlet pipe 24 from the separator 16. The extent to which the liquid flow control valve 21 is closed depends on the size of the gas slug detected. When normal flow from the production fluid pipeline 9 resumes, the liquid flow control valve 21 will be returned to its initial state under the control of the control means 68.

When a gas slug is dealt with as described above, the operation of the hydrocyclone will be effected as it will be when the ratio of oil to water in the production fluid varies.

If the oil-in-water sensor 38 detects that water leaving the hydrocyclone contains more than the prescribed amount of oil, it sends a signal to the control means 68 which closes the water flow control valve 42 which diverts pumped water through the water recirculation pipe 46, the flow restrictor 48 and second non-return valve 50 to the inlet 30 of the hydrocyclone 32 for the removal of further oil. Once the oil-in-water sensor 38 detects that the oil content of water leaving the hydrocyclone is sufficiently low, the water flow control valve 42 will be opened again and flow through the water recirculation pipe 46 will cease.

If the sensor 66 detects that the oil/water interface level in the hydrocyclone is not within prescribed limits for optimum separation, an appropriate signal is sent to the control means 68 which either adjusts the oil flow control valve 58 or the water flow control valve 42. For example, if it is necessary to increase the amount of oil in the hydrocyclone, the oil flow control valve 58 will be at least partially closed so that oil will be pumped via the oil recirculation pipe 62 and through the restrictor 64 back to the inlet of the pump, thus reducing or eliminating the amount of oil removed from the hydrocyclone until optimum amounts of oil and water are once more established in the hydrocyclone 32.

The use of rapidly adjustable electrically actuated flow control valves in the system permits the use of components such as a centrifugal separator and a hydrocyclone separator to be employed for the treatment of production fluid containing gas slugs. Furthermore, the system can be used to treat production fluid with a relatively wide range of gas to oil ratios without the need to replace the separators to cater for variations in this ratio.

The invention claimed is:

1. A system for separating fluids from a hydrocarbon well production fluid mixture at a subsea location including fluid separation means, said fluid separation means having a first and second fluid outlet for first and second fluids respectively, electrically actuable fluid flow control valve means, said fluid control valve means having a flow control valve for controlling flow through the first fluid outlet and a second flow control valve for controlling flow through the second outlet control means for controlling the control valve means to regulate the flow of fluids through the separation means, and means for recirculating at least a portion of the fluid flowing out of one of the fluid outlets when its associated flow control valve is at least partially closed.

2. A system claimed in claim 1, including a gas slug detection device for sensing the presence of a gas slug in the production fluid, and wherein the control means is arranged to adjust the control valve means in response to output from the gas slug detection device.

3. A system as claimed in claim 1, wherein the separation means includes a centrifugal separator having a gas outlet and a liquid outlet.

4. A system as claimed in claim 3, wherein the control valve means includes a flow control valve controlled by the control means to restrict flow through the liquid outlet when a gas slug enters the centrifugal separator in order to ensure that substantially no gas passes through the liquid outlet.

5. A system as claimed in claim 1, wherein the control valve means includes a separate flow control valve for controlling flow through each of the first and second fluid outlets.

6. A system as claimed in claim 1, wherein the liquid separation means includes a sensor the output of which is dependent on the amount of one or both of the fluids in the liquid separation means, and the or each flow control valve for controlling flow from the liquid separation means is controlled in response to output from the sensor.

7. A system as claimed in claim 6, wherein the sensor is adapted to sense an interface between the first and second fluids in the liquid separation means.

8. A system as claimed in claim 1, including a contamination sensor adapted to detect the contamination of one of the fluids by the other flowing through one of the fluid outlet, and one or both flow control valves are controlled in response to the contamination sensor.

9. A system as claimed in claim 8, wherein the contamination sensor is adapted to sense the amount of oil in water flowing out of the liquid separation means.

10. A system as claimed in claim 9, including water recirculation means for returning water to the liquid separation means for further processing when the contamination sensor senses the amount of oil in water to be above a particular threshold.

11. A system as claimed in claim 1, wherein a pump is situated between at least one said fluid outlet and its associated flow control valve for drawing one of the fluids through the respective outlet.

12. A system as claimed in claim 1, wherein the liquid separation means comprises a hydrocyclone separator.

13. A retrievable module including the system as claimed in claim 1.

14. A method of separating fluids from a hydrocarbon well production fluid mixture at a subsea location including providing fluid separation means, said fluid separation means having a first and second fluid outlet for first and second fluids respectively, electrically actuable fluid flow control valve means, said fluid control valve means having a flow control valve for controlling flow through the first fluid outlet, control means for controlling the control valve means to regulate the flow of fluids through the separation means, and means for recirculating at least a portion of the fluid flowing out of one of the fluid outlets when its associated flow control valve is at least partially closed.

* * * * *